US010974944B2

(12) United States Patent
Lee et al.

(10) Patent No.: US 10,974,944 B2
(45) Date of Patent: Apr. 13, 2021

(54) WATER DISPENSING APPARATUS AND CONTROL METHOD THEREFOR

(71) Applicant: LG Electronics Inc., Seoul (KR)

(72) Inventors: Myounghoon Lee, Seoul (KR); Sangki Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/752,385

(22) Filed: Jan. 24, 2020

(65) Prior Publication Data

US 2020/0354210 A1 Nov. 12, 2020

(30) Foreign Application Priority Data

May 9, 2019 (KR) ..... 10-2019-0054589

(51) Int. Cl.
*B67D 1/08* (2006.01)
*B67D 1/00* (2006.01)

(52) U.S. Cl.
CPC ..... *B67D 1/0884* (2013.01); *B67D 1/0014* (2013.01); *B67D 1/0895* (2013.01)

(58) Field of Classification Search
CPC ... B67D 1/0884; B67D 1/0895; B67D 1/0014
USPC ..... 222/146, 2, 1, 54, 129.1, 640, 145.1; 62/389–400
See application file for complete search history.

(56) References Cited

U.S. PATENT DOCUMENTS 6,164,189 A * 12/2000 Anson ..... A47J 31/56 99/281
8,636,174 B1 * 1/2014 Motkowski ..... B67D 3/0016 222/1
2005/0066820 A1 * 3/2005 Lussi ..... A47J 31/5253 99/279
2007/0251261 A1 * 11/2007 Son ..... F25D 23/126 62/390
2009/0321335 A1 * 12/2009 Siemer ..... C02F 9/005 210/175

(Continued)

FOREIGN PATENT DOCUMENTS

JP H1079294 3/1998
JP 2006347557 12/2006

(Continued)

OTHER PUBLICATIONS

PCT International Search Report in International Appin. No. PCT/KR2020/005667, dated Jul. 31, 2020, 13 pages.

*Primary Examiner* — Lien M Ngo
(74) *Attorney, Agent, or Firm* — Fish & Richardson P.C.

(57) ABSTRACT

A water dispensing apparatus includes: a filter; a hot water tank; a water discharge nozzle; a hot water pipe connecting the hot water tank to the water discharge nozzle; a hot water discharge valve; a drain pipe branched from the hot water pipe; a drain valve disposed at the drain pipe; a first temperature sensor disposed in the hot water tank and configured to detect a first temperature of the hot water tank or water in the hot water tank; a second temperature sensor disposed in the hot water discharge valve and configured to detect a second temperature of water that is in the hot water pipe or introduced into the hot water discharge valve; and a controller configured to control the hot water discharge valve and the drain valve based on temperature information including the first temperature and the second temperature.

20 Claims, 8 Drawing Sheets

(56) References Cited

U.S. PATENT DOCUMENTS

| | | | | |
|---|---|---|---|---|
| 2010/0112165 | A1* | 5/2010 | Masciandaro | A47J 31/405 426/433 |
| 2016/0031694 | A1* | 2/2016 | Orita | B67D 1/07 222/638 |
| 2016/0168827 | A1* | 6/2016 | Lee | E03B 7/08 137/12 |
| 2017/0325294 | A1 | 11/2017 | Kim et al. | |
| 2017/0343275 | A1* | 11/2017 | Kim | F25D 23/126 |
| 2018/0195793 | A1* | 7/2018 | Kim | F25D 23/126 |

FOREIGN PATENT DOCUMENTS

| | | |
|---|---|---|
| JP | 2007223660 | 9/2007 |
| JP | 2009255972 | 11/2009 |
| KR | 2012-0112060 | 10/2012 |
| KR | 20170125561 | 11/2017 |

* cited by examiner

WATER DISPENSING APPARATUS AND CONTROL METHOD THEREFOR

CROSS-REFERENCE TO RELATED APPLICATION

This application claims the benefit of priority to Korean Patent Application No. 10-2019-0054589, filed in the Korean Intellectual Property Office on May 9, 2019, the entire contents of which are incorporated herein by reference.

TECHNICAL FIELD

The present disclosure relates to a water dispensing apparatus capable of stably generating hot water at a constant temperature, and a control method therefor.

BACKGROUND

A water dispensing apparatus may supply water to a user and dispense water according to the user's operation.

For example, a water dispensing apparatus, when the user operates a lever or a button, may dispense stored water through a nozzle. In some cases, the water dispensing apparatus may include a valve of the nozzle that is opened to dispense water while the user operates the lever or the button. The user may stop operation of the lever or the button while checking the amount of water filled in a cup or the container.

A water dispensing apparatus may be applied to various fields. For example, the water dispensing apparatus may be applied to a refrigerator and a water purifier. In some cases, the water dispensing apparatus, which is provided in the refrigerator and the water purifier, may automatically supply a set amount of water according to the user's operation. In some cases, a water dispensing apparatus may supply not only purified water but also cold water and hot water.

In some cases, where a flow rate of hot water supplied from the water dispensing apparatus is not constant, the temperature of hot water may vary in a large range. For example, when the supply flow rate is lowered, the water may be overheated by a heater that heats the water with fixed power, which may lead to damage to the heater or cause the water to boil and generate steam. In some cases, overheated water may cause breakage of a flow path or occurrence of safety problems.

In some cases, the water dispensing apparatus may include a hot water supply device that detects a flow rate of water supplied and prevents the heater from operating when a flow rate of incoming water is less than a flow rate in minimum operation.

In some cases, where the flow rate is unstable, the heater may be turned off, which may result in an unsatisfied temperature of water for dispensing.

In some cases, the water dispensing apparatus may allow hot water of a constant temperature to be dispensed by adjusting power of an induction heating-type hot water module according to a decrease in the supply flow rate or a temperature of discharged water.

In some examples, a water dispensing apparatus may store a previous water discharge amount, set a valve opening degree automatically, and perform flow control through the valve opening degree stored at the time of hot water dispensing.

In some cases, where water enters a hot water tank at a flow rate that is lower than a previous amount of water discharged, a boiling phenomenon may occur in the hot water tank, and consequently hot water may bounce off from the dispenser, which may lead to safety accidents.

In some cases, where a preheat operation is performed in the same manner regardless of an elapsed time after a previous hot water dispensing event with a relatively short time term, the hot water tank may be overheated and cause a boiling phenomenon in the hot water tank. In some cases, it may be difficult to provide hot water with a substantially constant temperature.

In some cases, where water is dispensed with a relatively long time term after the previous hot water dispensing event, the hot water in the hot water tank may have a temperature in an unsatisfied state, or the hot water may be dispensed while the temperature of the hot water flowing into a water discharge nozzle is lowered due to the influence of residual water in a pipe.

An adaptive control according to situations in the process of a preheat operation may enable generation of hot water having a constant temperature to avoid overheating in the hot water tank or an unsatisfied temperature of hot water.

SUMMARY

The present disclosure describes a water dispensing apparatus capable of always providing hot water satisfying a temperature condition to a user and a control method therefor.

The present disclosure also describes a water dispensing apparatus capable of preventing hot water from boiling in a hot water tank and a pipe due to overheating, thereby more safely providing hot water to a user, and a control method therefor.

According to one aspect of the subject matter described in this application, a water dispensing apparatus includes: a filter configured to purify incoming water; a hot water tank configured to receive and heat water having passed through the filter; a water discharge nozzle configured to supply hot water generated in the hot water tank to a user; a hot water pipe connecting the hot water tank to the water discharge nozzle; a hot water discharge valve disposed at the hot water pipe and configured to control water flow through the hot water pipe; a drain pipe branched from the hot water pipe; a drain valve disposed at the drain pipe and configured to control flow of water introduced from the hot water pipe into the drain pipe; a first temperature sensor disposed in the hot water tank and configured to detect a first temperature of the hot water tank or water in the hot water tank; a second temperature sensor disposed in the hot water discharge valve and configured to detect a second temperature of water that is in the hot water pipe or introduced into the hot water discharge valve; and a controller configured to control the hot water discharge valve and the drain valve based on temperature information including the first temperature and the second temperature.

Implementations according to this aspect may include one or more of the following features. For example, the controller may include a timer configured to, based on receiving a hot water dispensing command from the user, determine an elapsed time from a previous hot water dispensing event to a time point corresponding to the hot water dispensing command.

In some implementations, the controller may be configured to: based on the elapsed time being less than a reference time, determine that the hot water dispensing command corresponds to a repetitive dispensing event; and perform a preheat operation of the hot water tank corresponding to the repetitive dispensing event in a state in which the hot water discharge valve is closed and the drain valve is opened.

In some examples, the controller may be configured to finish the preheat operation based on (i) an elapse of a predetermined preheat time from beginning of the preheat operation or (ii) the first temperature being equal to a predetermined target temperature. In some examples, the controller may be configured to, based on completion of the preheat operation, close the drain valve and open the hot water discharge valve to thereby dispense hot water through the water discharge nozzle.

In some implementations, the controller may be configured to: based on the elapsed time being greater than or equal to a reference time, determine that the hot water dispensing command corresponds to an individual dispensing event; and perform a preheat operation of the hot water tank corresponding to the individual dispensing event in a state in which the hot water discharge valve is closed and the drain valve is opened.

In some examples, the controller may be configured to finish the preheat operation based on an elapse of a predetermined preheat time from beginning of the preheat operation. In some examples, the controller may be configured to open the hot water discharge valve to thereby dispense hot water through the water discharge nozzle based on the second temperature becoming greater than a predetermined reference temperature after completion of the preheat operation.

In some implementations, the controller may be configured to compare the first temperature to one or more preset temperatures based on the second temperature being less than a predetermined reference temperature after completion of the preheat operation. In some examples, the controller may be configured to, based on the first temperature being greater than or equal to a first preset temperature among the one or more preset temperatures, open the hot water discharge valve to thereby dispense hot water through the water discharge nozzle.

In some examples, the controller may be configured to, based on the first temperature being less than the first preset temperature, open the drain valve to thereby perform a drain operation for draining water through the drain pipe before dispensing hot water through the water discharge nozzle. In some examples, the controller may be configured to determine a drain duration of the draining operation by subtracting the predetermined preheat time from one or more predetermined drain durations.

In some implementations, the controller may be configured to increase the one or more predetermined drain durations in a stepwise manner based on a decrease of the first temperature. In some examples, the controller may be configured to, based on completion of the drain operation, close the drain valve and open the hot water discharge valve to thereby dispense hot water through the water discharge nozzle.

According to another aspect, a control method for a water dispensing apparatus includes: receiving a hot water dispensing command from a user; based on receiving the hot water dispensing command, determining an elapsed time from a previous hot water dispensing event to a time point corresponding to the hot water dispensing command; comparing the elapsed time to a predetermined reference time; based on the elapsed time being less than the predetermined reference time, determining that the hot water dispensing command is a repetitive dispensing event, and performing both of (i) a preheat operation configured to heat water in a hot water tank of the water dispensing apparatus and (ii) a drain operation configured to drain water from the water dispensing apparatus; and dispensing hot water based on completion of both of the preheat operation and the drain operation.

According to another aspect, a control method for a water dispensing apparatus includes: receiving a hot water dispensing command from a user; based on receiving the hot water dispensing command, determining an elapsed time from a previous hot water dispensing event to a time point corresponding to the hot water dispensing command; comparing the elapsed time to a predetermined reference time; based on the elapsed time being greater than or equal to the predetermined reference time, determining that the hot water dispensing command corresponds to an individual dispensing event, and performing a preheat operation configured to heat water in a hot water tank of the water dispensing apparatus; detecting a temperature of hot water flowing into a discharge nozzle of the water dispensing apparatus; comparing the temperature of hot water to a reference temperature; and dispensing hot water based on the temperature of hot water being greater than or equal to the reference temperature.

According to another aspect, a control method for a water dispensing apparatus includes: receiving a hot water dispensing command from a user; based on receiving the hot water dispensing command, determining an elapsed time from a previous hot water dispensing event to a time point corresponding to the hot water dispensing command; comparing the elapsed time to a predetermined reference time; based on the elapsed time being greater than or equal to the predetermined reference time, determining that the hot water dispensing command corresponds to an individual dispensing event, and performing a preheat operation configured to heat water in a hot water tank of the water dispensing apparatus; detecting a temperature of hot water flowing into a discharge nozzle of the water dispensing apparatus; comparing the temperature of hot water to a reference temperature; based on the temperature of hot water being less than the reference temperature, performing a drain operation configured to drain water from the water dispensing apparatus; and dispensing hot water based on completion of the drain operation.

Implementations according to this aspect may include one or more of the following features. For example, the method may further include comparing a temperature of the hot water tank to a first preset temperature based on the temperature of hot water being less than the reference temperature.

In some implementations, performing the preheat operation may include performing the preheat operation for a predetermined preheat time, and the method may further include determining a drain duration of the draining operation by subtracting the predetermined preheat time from one or more predetermined drain durations. In some examples, determining the drain duration may include increasing the one or more predetermined drain durations based on a decrease of the temperature of hot water.

In some implementations, in the individual dispensing event, the drain operation and preheat operation may be performed, thereby preventing the boiling of water in the hot water tank, and further, preventing the hot water of a high temperature in the water discharge nozzle from being splashed or bouncing around the nozzle.

In some implementations, in the repetitive dispensing event, only preheat operation may be performed, thereby more quickly generating the hot water in the hot water tank.

In some implementations, while dispensing hot water after the preheat operation, the temperature of hot water flowing into the discharge nozzle may be detected, and when the temperature of hot water is not satisfied, the hot water may be drained without being not supplied to the discharge nozzle, thereby preventing a situation in which hot water is supplied to the user in a state where the temperature of hot water is lowered due to the residual water in the pipe.

In some implementations, regardless of the individual dispensing event or the repetitive dispensing event, it may be possible to provide the user with hot water of a constant temperature.

DETAILED DESCRIPTION

Figure 1:
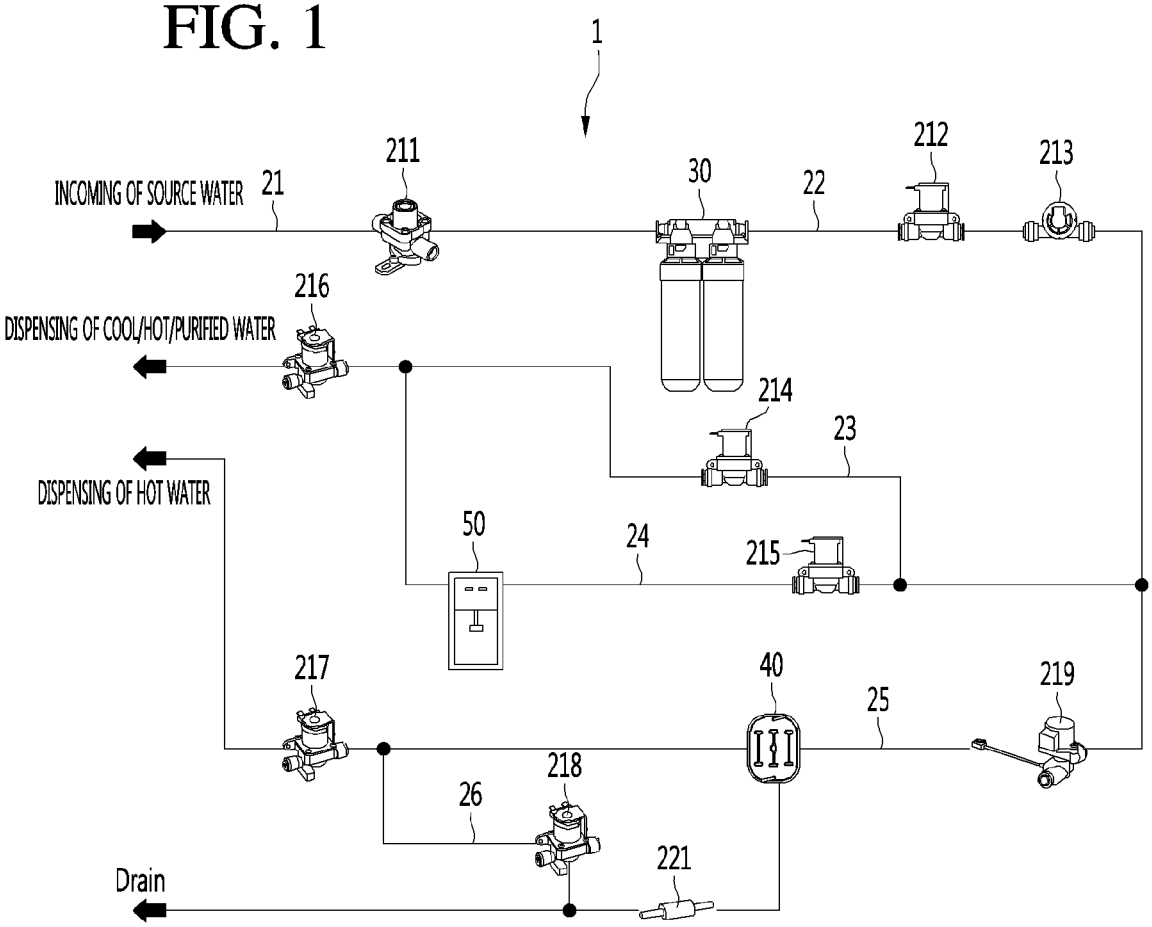
FIG. 1 is a water pipe diagram showing an example of a water dispensing apparatus.

One or more implementations according to the present disclosure will be described with reference to the drawings.

In some examples, the size or shape of the components shown in the drawings may be exaggerated for clarity and convenience of description.

In some implementations, terms that are specifically defined in consideration of the configuration and operation of the present disclosure may vary depending on the intention or custom of the user or operator. Definitions of these terms should be made based on the contents throughout the specification.

The water dispensing apparatus according to the present disclosure may include various hot water generating apparatuses that may generate and discharge hot water, including a water purifier, a refrigerator, a vending machine, and the like.

FIG. 1 is a water pipe diagram showing an example of a water dispensing apparatus.

Referring to FIG. 1, a water dispensing apparatus may be connected to a source water pipe 21 connected to a water supply source outside a body in which a hot water module 40 is embedded. In some implementations, the water supplied by the source water pipe 21 may be purified to be purified water, be heated to generate hot water, and be then discharged into a water discharge nozzle exposed to the outside of the body.

In detail, the water dispensing apparatus may be supplied with source water through the source water pipe 21 connected from the water supply source. The source water pipe 21 may be introduced into the water dispensing apparatus.

In some implementations, the water dispensing apparatus may include a pressure reducing valve 211 for reducing the pressure of water and a filter 30 for purifying water which are sequentially disposed on the source water pipe 21.

For example, the source water passing through the filter 30 may be purified and then discharged as purified water.

The purified water passing through the filter 30 may flow to the side of the water discharge nozzle through the water supply pipe 22.

A feed valve 212 and a flow sensor 213 may be provided on the water supply pipe 22. The flow sensor 213 is configured to detect or measure a flow rate of water flowing through the water supply pipe 22. In some implementations, the feed valve 212 is configured to have a valve structure capable of adjusting an opening degree, thus adjusting a flow rate of the water flowing through the water supply pipe 22. Therefore, a fixed amount of water may flow through the water supply pipe 22.

The water supply pipe 22 may be branched into a purified water pipe 23, a cold water pipe 24, and a hot water pipe 25.

For example, when the user wants purified water having a room temperature to be discharged, the purified water discharge valve 214 disposed in the purified water pipe 23 is opened, and purified water flows into the purified water pipe 23. When the purified water discharge valve 214 is opened, water passing through the flow sensor 213 may be provided to the user after passing through the purified water pipe 23. The water passing through the purified water pipe 23 is water from which foreign matters are filtered out by the filter 30.

As another example, when the user wants outlet of cold water lower than the room temperature, the cold water discharge valve 215 disposed in a cold water pipe 24 is opened. When the cold water discharge valve 215 opens the cold water pipe 24, the water passing through the flow sensor 213 may be guided to the cold water module 50 and cooled. The cold water module 50 may cool water passing through the inside by a refrigerant cooled by a compressor or the like. In some implementations, the water may be cooled while passing through the inside of the tank cooled by thermoelectric elements. The cold water cooled while passing through the inside of the cold water module 50 may be provided to the user.

The cold water module 50 may be formed with a flow path through which a coolant may move so as to efficiently exchange heat with water passing through the inside.

The cold water module 50 may include a drain tube through which coolant may be discharged as needed.

As another example, when the user wants dispensing of hot water, the hot water discharge valve 217 opens the hot water pipe 25. In this case, the water passing through the flow sensor 213 is guided to a flow rate control valve 219. The flow rate control valve 219 may adjust the flow rate through which water passes. The water passing through the flow rate control valve 219 is heated while passing through the hot water module 40, and hot water may be provided to the user through the hot water outlet valve 217.

In some implementations, the drain pipe 26 for guiding water to the drain valve 218 is connected to the hot water pipe 25 connecting the hot water module 40 and the hot water outlet valve 217. That is, the water passing through the hot water module 40 may be provided to the user through the hot water outlet valve 217 or may be discharged to the outside through the drain valve 218.

In detail, among the hot water heated by the hot water module 40, hot water (hot water at a low temperature) of which the temperature condition is not satisfied, is discharged through the drain valve 218 and may not be provided to the user. Specific implementations related thereto will be described later with reference to the drawings.

In some examples, when water is heated by the hot water module 40, if the pressure is excessively increased, the pressure may be lowered through a safety valve 221. Therefore, it is possible to stably use the hot water module 40 by preventing the hot water module 40 from being under an excessive pressure. The safety valve 221 may have a structure in which water, steam, air, and the like may be discharged, thereby lowering the pressure of the hot water tank 41 (see FIG. 3) in the hot water module 40.

The water passing through the drain valve 218 or the safety valve 221 is not provided to the user, but is discharged to the outside through a separate pipe.

In some examples, the flow rate control valve 219 is provided with an incoming water temperature sensor (not shown) to measure the temperature of the water passing through the flow rate control valve 219. The incoming water temperature sensor (not shown) may measure the temperature of water before flowing to the hot water module 40.

In some implementations, the hot water module 40 is provided with a first temperature sensor 110, to measure a temperature of the hot water tank 41 or a temperature of the hot water in the hot water tank 41 generated in the hot water tank 41.

In some implementations, the hot water outlet valve 217 is provided with a second temperature sensor 120 to measure a temperature of water flowing into the hot water outlet valve 217. The water passing through the hot water outlet valve 217 is finally provided to the user.

According to the temperature of the hot water detected by the second temperature sensor 120, whether the hot water outlet valve 217 is opened or closed may be determined.

Therefore, the second temperature sensor 120 may measure a final temperature of the hot water provided to the user.

For reference, the second temperature sensor 120 may detect a temperature of water flowing into the hot water outlet valve 217 or a temperature of hot water in a hot water pipe connecting the hot water tank 41 and the hot water outlet valve 217.

Figure 2:
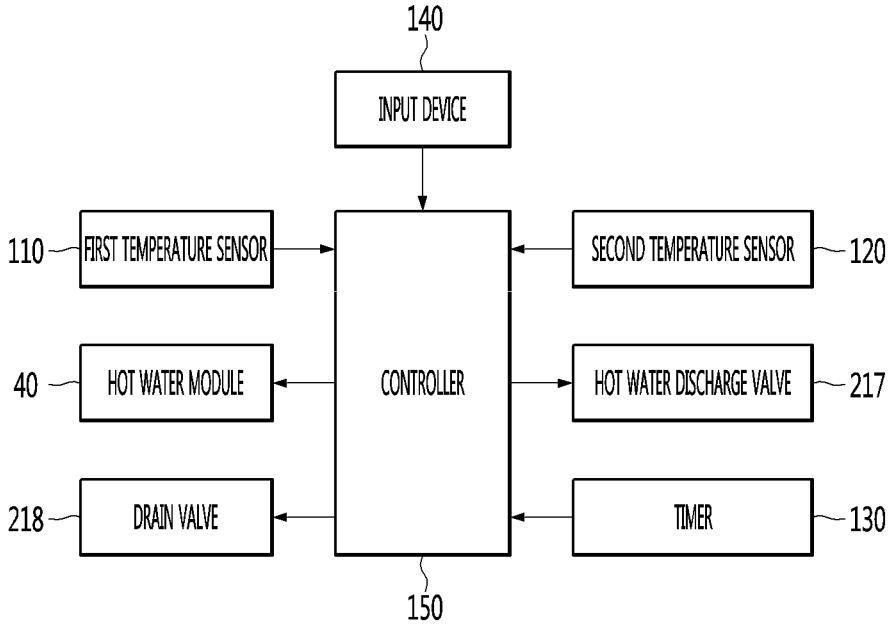
FIG. 2 is a block diagram showing an example configuration of the water dispensing apparatus.

FIG. 2 is a block diagram showing an example configuration of the water dispensing apparatus.

Hereinafter, the components shown in FIG. 1 will be described with reference to FIG. 2.

Information on temperatures measured by the first temperature sensor 110 and the second temperature sensor 120 is transmitted to the controller 150.

In some implementations, an elapsed time measured by the timer 130 is also transmitted to the controller 150.

When an N-th hot water discharge command is input from the user, the timer 130 may measure an elapsed time after (N−1)-th hot water discharge.

When the N-th hot water discharge command is input from the user, the timer 130 may measure a time that elapses from a time when (N−1)-th hot water discharge is started to a time when the N-th hot water discharge command is input.

When the N-th hot water discharge command is input from the user, the timer 130 may measure a time that elapses from a time when (N−1)-th hot water discharge is terminated to a time when the N-th hot water discharge command is input.

In some implementations, the water dispensing apparatus may be provided with an input device 140 through which a user is able to input a specific command. The input device 140 may be provided in various types, such as a button type or a touch display type. In some implementations, the user may select dispensing of cold water, purified water, or hot water through the input device 140. The input device 140 may allow a user to select dispensing of a fixed amount of water, so that the user may receive a predetermined amount of water.

The input device 140 may be provided with a window for providing information to the user. Through the window, the user may be provided with various information such as information related to the hot water supply device or weather.

The controller 150 may drive the cold water module 50 and the hot water module 40 through various information received from the above-described components.

When the user inputs a selection to receive cold water to the input device 140, the controller 150 may drive the cold water module 50.

In some examples, when the user inputs a selection to receive hot water to the input device 140, the controller 150 may drive the hot water module 40.

In some implementations, when the user inputs a selection to receive purified water to the input device 140, the controller 150 may not drive both the hot water module 40 and the cold water module 50.

The controller 200 may individually operate the hot water discharge valve 217 and the drain valve 218, as well as the cold water discharge valve 215 and the purified water discharge valve 214. In some implementations, it is possible to open or close the flow path of each valve. In some implementations, it is possible to operate a common valve 216 (see FIG. 1) installed on a water discharge pipe connecting the purified water pipe 23 and the cold water pipe 24 and the water discharge nozzle to control the flow of purified water and cold water supplied to the water discharge nozzle.

The flow rate control valve 219 may change a flow rate of the water passing through the hot water pipe 25, thereby adjusting the flow rate or flow amount of the water guided to the hot water module 40. The flow rate control valve 219 may be adjusted to increase the flow rate to allow a large amount of water to pass during the same time, or to decrease the flow rate to allow a small amount of water to pass during the same time.

When the user inputs a hot water dispensing command to the input device 140, the controller 150 may open the flow rate control valve 219 and open the hot water discharge valve 217 to provide hot water to the user finally. In some implementations, the controller 150 may individually or simultaneously open the flow rate control valve 219 and the hot water discharge valve 217.

When the user inputs a cold water dispensing command to the input device 140, the controller 150 may open the cold water discharge valve 215 and the common valve 216 to supply cold water to the user.

When the user inputs a purified water dispensing command to the input device 140, the controller 150 may open the purified water discharge valve 214 and the common valve 216 to supply the purified water passing through the filter 20 to the user.

Hereinafter, a structure of the hot water module 40 will be described in more detail.

Figure 3:
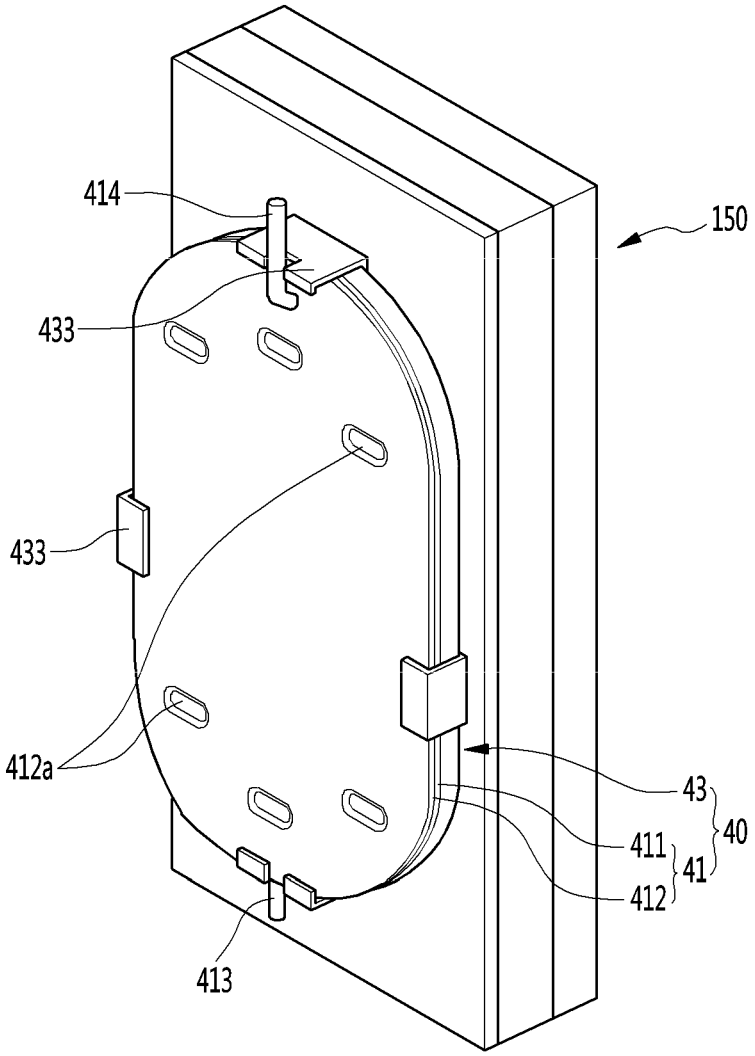
FIG. 3 is a perspective view showing an example of a hot water module of the water dispensing apparatus.
Figure 4:
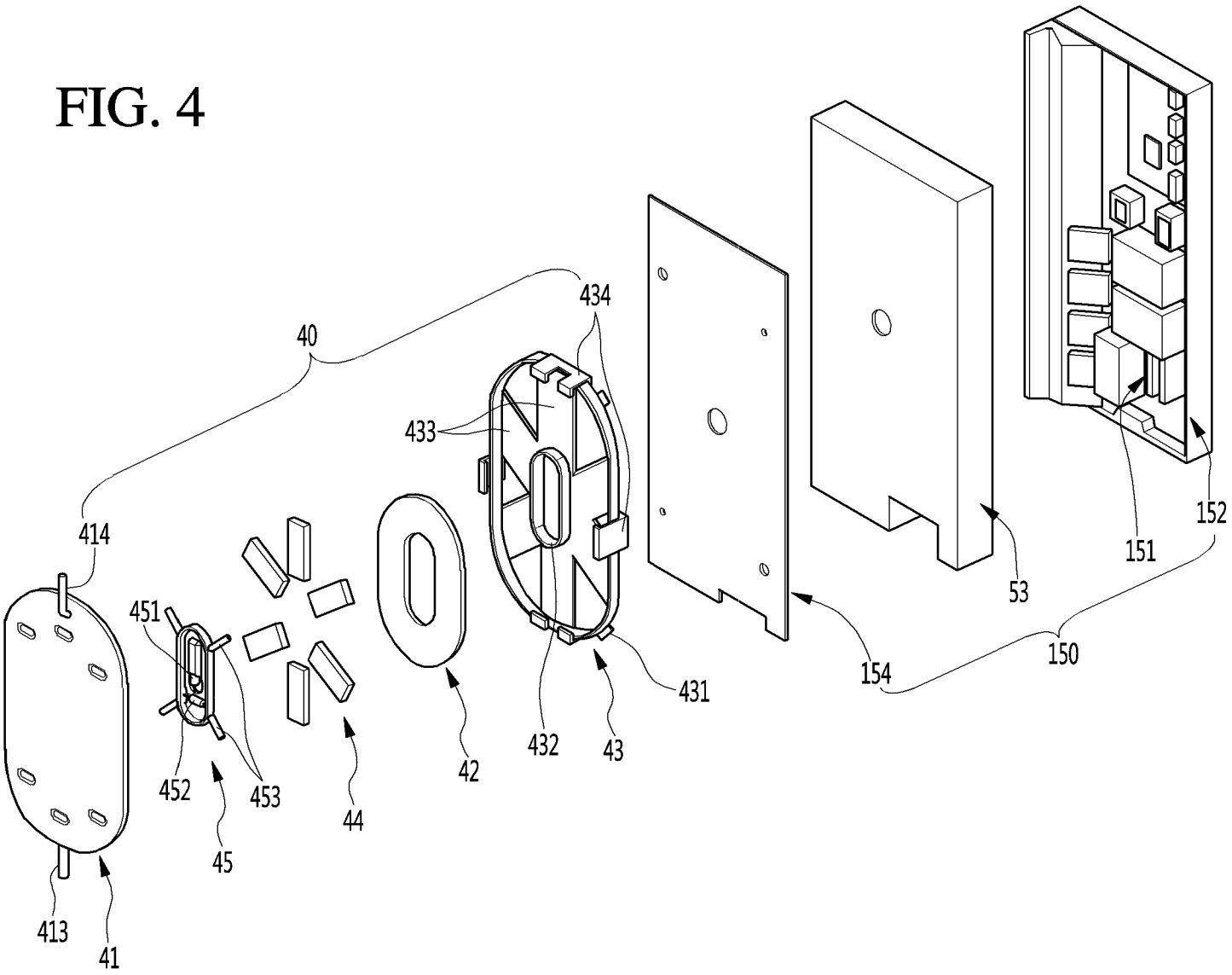
FIG. 4 is an exploded perspective view showing the hot water module.

FIG. 3 is a perspective view showing an example of a hot water module of the water dispensing apparatus. FIG. 4 is an exploded perspective view of the hot water module.

As shown in FIGS. 3 and 4, the hot water module 40 and the controller 150 may be combined to each other in a single module, and may be mounted inside the water dispensing apparatus 1 in a combined state.

The hot water module 40 may receive the purified water supplied through the hot water pipe 25 and heat the purified water to generate hot water, and is configured to perform heating in an induction heating (IH) method.

In some implementations, the hot water module 40 may include a hot water tank 41 through which purified water passes, a working coil 42 for heating water passing through the hot water tank 41, and a mounting bracket 43 in which the working coil 42 and the hot water tank 41 are mounted.

The mounting bracket 43 may provide a mounting space for the hot water tank 41, the working coil 42, and a ferrite core 44. In some implementations, the mounting bracket 43 may be formed of a resin material that is not deformed or damaged even at a high temperature.

A bracket coupling portion 431 for coupling with the controller 150 may be formed at a corner of the mounting bracket 43. The bracket coupling portion 431 may be provided in plural, and extended ends of the bracket coupling portion 431 may be formed in different shapes, and may be formed to have directivity. Thus, the hot water module 40 may have a structure that is shape-fitted with the controller 150, the hot water module 40 may be mounted at the correct position.

In some implementations, a bracket mounting portion 432 for mounting the sensor bracket 45 may be further formed at the center of one surface of the mounting bracket 43 on which the hot water tank 41 is mounted. A tank temperature sensor 451 and a fuse 452 may be provided at the center of the bracket mounting portion 432.

The sensor bracket 45 may be equipped with a tank temperature sensor 451 for measuring a temperature of the hot water tank 41. The tank temperature sensor 451 may determine a temperature of the hot water without directly measuring the temperature of the hot water in the hot water tank 41 by measuring the temperature of the center of the hot water tank 41. Therefore, the temperature of the hot water detected by the tank temperature sensor 451 may be maintained in an appropriate range. That is, whether to perform further heating or stop heating may be determined to perform control according to the temperature detected by the tank temperature sensor 451.

In some implementations, the fuse 452 may be mounted on the sensor bracket 45. The fuse 452 may cut off power of the hot water module 40 when the water in the hot water tank 41 is excessively overheated.

A plurality of coil fixing portions 453 may be formed around the sensor bracket 45. The coil fixing portions 453 may extend outwardly from the outer surface of the sensor bracket 45, and may extend to fix the working coil 42 mounted in the mounting bracket 43. Two coil fixing portions 453 may be provided in each of the upper and lower portions of the sensor bracket 45, each extending in a diagonal direction from both corners to press and fix the working coil 42.

The working coil 42 is provided on the front surface of the mounting bracket 43. The working coil 42 may form magnetic lines of force causing heat generation of the hot water tank 41. When current is supplied to the working coil 42, magnetic lines of force are formed in the working coil 42. The magnetic lines of force may affect the hot water tank 41, and the hot water tank 41 is affected by the magnetic lines of force line to be heated.

The working coil 42 is disposed on the front surface of the mounting bracket 43, and is disposed to face one side with a planar shape among both sides of the hot water tank 41. The working coil 42 may consist of several strands of copper or other conductor wires and the strands may be insulated from each other. The working coil 42 may form a magnetic field or magnetic lines of force by the current applied to the working coil 42.

Therefore, the front surface of the hot water tank 41 facing the working coil 42 may generate heat by being affected by the magnetic lines of force formed by the working coil 42. The strands of the working coil 42 are not shown in detail in the drawings, and there is shown only the overall contour of the working coil 42 formed in such a way that the strands are wound around the bracket mounting portion 432.

The front surface of the working coil 42 may be provided with a ferrite core 44. The ferrite core 44 is to suppress the loss of current, and serves as a shielding film for the magnetic lines of force. The working coil 42 may include a plurality of ferrite cores 44, and the plurality of ferrite cores 44 may be radially arranged based on the central portion of the working coil 42.

The ferrite core 44 may be fixed to a core fixing portion 433 of the mounting bracket 43. The ferrite core 44 may be attached to the core fixing portion 433, or may be provided with a structure to which the ferrite core 44 is press-inserted or shape-fitted. A plurality of core fixing portions 433 may be formed in a radial manner, such as the arrangement of the ferrite cores 44.

In some implementations, a coupling portion 434 may be further formed around the mounting bracket 43 such that an end of the hot water tank 41 may be locked and fixed in a state in which the hot water tank 41 is mounted. Accordingly, the hot water tank 41 may be coupled to the mounting bracket 43 in a single module form in a state in which the working coil 42, the ferrite core 44, the sensor bracket 45, and the hot water tank 41 are mounted.

The hot water tank 41 is mounted on the front surface of the mounting bracket 43. The hot water tank 41 may be configured to generate heat under the influence of the magnetic lines of force formed by the working coil 42. Therefore, the purified water is heated while passing through the internal space of the hot water tank 41 to become hot water.

In some implementations, the overall shape of the hot water tank 41 may be formed in a flat and compact shape. In some implementations, the hot water tank 41 may be formed to correspond to the overall shape of the hot water module 40 to effectively heat the hot water tank 41 when the hot water module 40 is driven.

In some implementations, the hot water tank 41 may be configured in such a way that a plate-shaped first tank portion 411 and a plate-shaped second tank portion 412 which is at least partially recessed to form a flow path are joined to each other at theirs circumferences. In some implementations, an outlet tube/pipe 414 for discharging heated water is formed at an upper end of the hot water tank 41, and an inlet tube 413 for supplying water for heating is formed at a lower end of the hot water tank 41. Accordingly, the hot water tank 41 is instantaneously heated by the induced electromotive force formed in the working coil 42 in a process of allowing water to flow such that the water is introduced into the inlet tube 413 and discharged to the outlet tube 414, thereby enabling dispensing of hot water.

In some examples, a first tank portion 411 may have a surface facing the working coil, which is formed in a planar shape and disposed adjacent to the working coil 42 so that the entire surface is evenly heated by the induced electromotive force generated in the working coil 42.

In some implementations, a plurality of forming portions **412*a* may be formed in a second tank portion 412. The forming portion 412***a* is recessed to face the first tank portion 411, and bring into contact with an inner surface of the first tank portion 411 to allow the first tank portion 411 and the second tank portion 412 to maintain a space formed by being spaced from each other when the first tank portion 411 and the second tank portion 412 are coupled to each other. Therefore, the first tank portion 411 and the second tank portion 412 may form a space in which water may flow, due to the forming portion 412*a*.

In some implementations, the plurality of forming portions 412*a* may be formed at positions adjacent to an inlet tube 413 and an outlet tube 414, respectively, or may be spaced apart from each other in the width direction of the hot water tank 41. Therefore, by allowing the water flowing in the hot water tank 41 to be dispersed in and flow through the entire area inside the hot water tank 41, thereby achieving effective heating by the working coil 42. That is, the water flowing in the hot water tank 41 having a thin thickness and a large area may be heated by the working coil 42 quickly and rapidly to be heated to a temperature required for water dispensing.

The controller 150 may be provided at the rear of the hot water module 40. The controller 150 may be connected to a plurality of valves and electronic devices such as the hot water module 40, the flow rate sensor 213, the feed valve 212, the hot water discharge valve 217, the drain valve 218, the first temperature sensor 110, the second temperature sensor 120, the input device 140, and the timer 130. In some cases, a plurality of controllers 150 may be provided and divided into a part for controlling the hot water module 40 and a part for controlling other components.

The controller 150 may include a control PCB 151, a control case 152, and a control cover 153. The control PCB 151 is for controlling the driving of the hot water module 40 and may be mounted to the control case 152. The control PCB 151 may control driving of valves connected to the hot water module 40.

The control case 152 may accommodate the control PCB 151 therein, and an open surface thereof may be shielded by the control cover 153. Therefore, the control PCB 151 may maintain a state of being accommodated by the coupling of the control case 152 and the control cover 153.

A shield plate 154 may be provided on the front surface of the control cover 153. The shield plate 154 may block magnetic lines of force from being transferred to the control PCB 151 when the hot water module 40 is driven, and may be formed on the entire front surface of the control cover 153. The shield plate 154 may be formed in a separate sheet shape and may be mounted on the front surface of the control cover 153.

Hereinafter, one or more control methods for a dispensing apparatus having the above-described structure will be described.

In the following description, a 'first cup' event may be defined by various criteria.

For example, a hot water dispensing event may be classified into an individual dispensing event (a 'first cup' event) and a repetitive dispensing event (a 'repetitive cup' event) according to the elapsed time after hot water is discharged into a discharge nozzle. In detail, when an N-th hot water dispensing is performed in a state where a reference time Ta is set, when the reference time Ta has elapsed after a previous (N−1)-th hot water dispensing is performed, the N-th hot water dispensing is determined as a 'first cup' event. When the reference time Ta has not elapsed since the previous (N−1)-th hot water dispensing is performed, the N-th hot water dispensing is determined as a 'repetitive cup' event.

As another example, classification into the 'first cup' and the 'repetitive cup' events may be performed according to a temperature of water filled in the hot water pipe 25 connecting the hot water discharge valve 217 and the hot water module 40. In detail, in a case where hot water dispensing is performed while a reference temperature is set, when the temperature of water introduced into the hot water pipe 25 or the hot water discharge valve 217 is lower than the reference temperature, the dispensing of hot water is determined as the first cup event. In some examples, when the temperature of the water introduced into the hot water pipe 25 or the hot water outlet valve 217 is higher than or equal to the reference temperature, the hot water dispensing is determined as a repetitive cup event.

In other implementations, various criteria may be applied to distinguish the first cup and the repeating cup events.

In some implementations, when any one of various criterion examples for determining the first cup described above is satisfied, hot water dispensing may be determined as the first cup event, and only when a plurality of criteria are satisfied, hot water dispensing may be determined as the first cup. The hot water dispensing may also be determined as the first cup when all the criteria are satisfied.

In the case of water dispensing for the 'repetitive cup' event, a control method for the water dispensing apparatus may include steps of receiving an n-th hot water dispensing command from a user, and comparing an elapsed time after an (n−1)-th hot water dispensing (i.e., a previous hot water dispensing event) is performed with a predetermined reference time Ta. When the elapsed time is less than the predetermined reference time Ta, the hot water dispensing command is determined as a 'repetitive cup' event, the drain operation and preheat operation may be performed simultaneously. After the preheat operation and drain operation are completed, hot water may be dispensed.

In the case of water dispensing for the 'first cup' event, the control method for the water dispensing apparatus may include steps of: receiving an n-th hot water dispensing command from a user; comparing an elapsed time after an (n−1)-th hot water dispensing is performed with a predetermined reference time Ta; when the elapsed time is greater than or equal to the predetermined reference time Ta, determining the hot water dispensing command corresponds to a 'first cup' event, performing preheat operation; after the preheat operation is completed, detecting a temperature of hot water flowing into a discharge nozzle; comparing the temperature of the hot water with a reference temperature T1; and when the temperature of the hot water is greater than or equal to the reference temperature T1 as a result of comparison, performing hot water dispensing.

In some implementations, in the case of water dispensing for the 'first cup' event, the control method for the water dispensing apparatus may include steps of: receiving an n-th hot water dispensing command from a user; comparing an elapsed time after an (n−1)-th hot water dispensing (i.e., a previous hot water dispensing event) is performed with a predetermined reference time Ta; when the elapsed time is greater than or equal to the predetermined reference time Ta, determining the hot water dispensing command corresponds to a 'first cup' event; performing preheat operation, after the preheat operation is completed, detecting a temperature of hot water flowing into a discharge nozzle; comparing the temperature of the hot water with a reference temperature T1; when the temperature of the hot water is less than the reference temperature T1 as a result of comparison; performing the drain operation; and when the drain operation is completed, performing hot water dispensing.

In some implementations, when the temperature of the hot water is less than the reference temperature T1 as a result of the comparison, a temperature of a hot water tank is compared with a first preset temperature T2, and when the temperature of the hot water tank is less than the first temperature T2, performing drain operation and then performing hot water dispensing.

In some implementations, a drain duration (i.e., a time for the drain operation) may be obtained by subtracting a preheat time Tc from a predetermined drain duration Td. In some examples, the predetermined drain duration Td may include one or more predetermined drain durations. For example, the one or more predetermined drain durations may include 4.0 s, 8.0 s, 8.5 s (see S213, S223, and S233 in FIG. 7).

In some examples, as the detected temperature of the hot water decreases, the drain duration Td may increase.

In some examples, as the detected temperature of the hot water increases, the drain duration Td may decrease.

Figure 5:
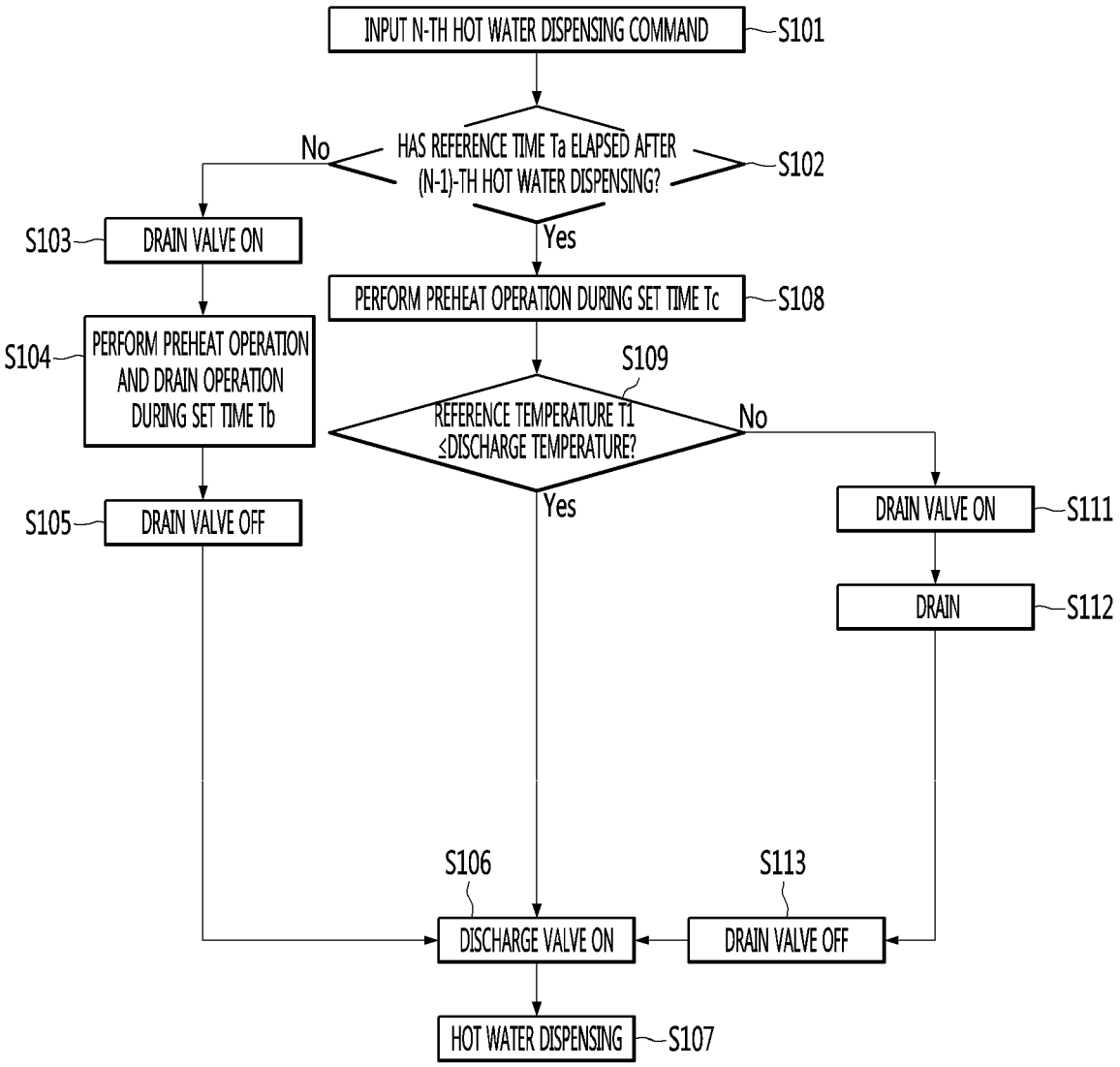
FIG. 5 is a flowchart showing an example of a control method for a water dispensing apparatus.

FIG. 5 is a flowchart showing an example control method for a water dispensing apparatus.

Referring to FIG. 5, first, an N-th hot water dispensing command is input from a user (S101).

For example, the N-th hot water dispensing command may be input by an operation in which the user presses a hot water button and a water dispensing button of the input device 140 in order.

In some implementations, the controller 150 may determine whether the N-th hot water dispensing is the 'first cup' event or the 'repetitive cup' event (S102).

The criteria for the first cup event and the repetitive cup event may be set in various manners.

For example, when the N-th hot water dispensing command is input, the first cup event and the repetitive cup event may be determined depending on whether an elapsed time (hereinafter, standby time) detected by the timer 130 after the (N−1)-th hot water discharging is performed exceeds the reference time Ta.

In some examples, when a waiting time has exceeded the reference time Ta, the 'first cup' event may be determined.

When the waiting time is less than or equal to the reference time Ta, a 'repetitive cup' may be determined.

For example, the reference time Ta may be set to 3 minutes.

First, in step S102, when an N-th hot water dispensing is the 'repetitive cup', preheat operation may be performed with drain operation.

As described above, when the N-th hot water dispensing is the 'repetitive cup', the temperature of the hot water tank 41 is maintained at a high temperature due to the influence of the (N−1)-th hot water dispensing. In this state, when only preheat operation is performed without drain operation, the temperature of the hot water tank 41 becomes too high, and a boiling phenomenon occurs in the hot water tank 41. Therefore, when the N-th hot water dispensing is the 'repetitive cup', drain operation is performed with preheat operation.

To this end, first, the drain valve 218 is opened (S103).

In this case, the hot water discharge valve 217 maintains a closed state.

Then, preheat operation and drain operation are performed during a set time Tb (S104).

When the set time Tb has elapsed, the drain valve 218 is closed (S105).

Then, the preheat operation and the raining are completed.

In step S104, the controller 150 may maintain the output of the working coil 42 for heating the hot water tank 41 substantially constant.

As another example, in step S104, the controller 150 may adjust the output of the working coil 42 for heating the hot water tank 41 in real time.

In detail, the controller 150 may detect factors such as a temperature of the hot water tank 41 or a temperature of hot water heated in the hot water tank 41, a temperature of purified water introduced into the hot water tank 41, a flow rate or flow speed of purified water introduced into the hot water tank 41, or the like in real time and adjust the output of the working coil 42 for heating the hot water tank 41 according to each factor.

Thereafter, the hot water discharge valve 217 is opened for hot water dispensing (S106).

Then, the hot water dispensing is performed through the water discharge nozzle (S107).

Then, after a set amount of hot water is discharged, the hot water dispensing is completed.

In some examples, in step S102, when the N-th hot water dispensing corresponds to the 'first cup' event, preheat operation is performed for a set time Tc (S108).

In this case, the drain valve 218 and the hot water discharge valve 217 maintain a closed state.

In step S108, the controller 150 may maintain the output of the working coil 42 for heating the hot water tank 41 substantially constant.

As another example, in step S108, the controller 150 may adjust the output of the working coil 42 for heating the hot water tank 41 in real time.

In detail, the controller 150 may detect factors such as a temperature of the hot water tank 41 or a temperature of hot water heated in the hot water tank 41, a temperature of purified water introduced into the hot water tank 41, a flow rate or flow speed of purified water introduced into the hot water tank 41, or the like in real time and adjust the output of the working coil 42 for heating the hot water tank 41 according to each factor.

Then, after the set time Tc has elapsed, the preheat operation is completed.

Thereafter, the controller 150 may compare a temperature of the hot water detected by the second temperature sensor 120 with a reference temperature T1 (S109).

When the detected temperature of hot water is equal to or greater than the reference temperature T1 as a result of comparison in step S109, the hot water discharge valve 217 is opened for hot water dispensing (S106).

Then, the hot water dispensing is performed through the water discharge nozzle (S107).

Then, after a set amount of hot water is discharged, the hot water dispensing is completed.

For reference, while the preheat operation is performed in step S108, a part of the hot water heated in the hot water tank 41 is discharged from the hot water tank 41, and the discharged hot water flows through a hot water pipe connecting the hot water tank 41 and the hot water discharge valve 217. Then, a temperature of water in the hot water pipe connecting the hot water tank 41 and the hot water discharge valve 217 rises due to the influence of the discharged hot water.

In some examples, when the detected temperature of the hot water is less than the reference temperature T1 as a result of the comparison in step S109, the drain operation is performed before the hot water dispensing through the water discharge nozzle.

To this end, the drain valve 218 is opened (S111).

Then, the drain operation of the residual water in the hot water pipe connecting the hot water tank 41 and the hot water discharge valve 217 is performed (S112).

When the temperature of the hot water detected by the second temperature sensor 120 is less than the reference temperature T1 after the preheat operation, the controller 150 determines that the temperature of the hot water discharged to the water discharge nozzle is unsatisfied, and causes the residual water in the hot water pipe to be drained.

When the drain operation is performed during a target time or the target amount of flow is drained, the drain valve 218 is closed and the drain operation is completed (S113).

The drain duration or drain flow rate may be set differently according to the temperature of the hot water tank, the temperature of the hot water in the hot water tank, or the temperature of the hot water detected by the second temperature sensor 120.

For example, the drain duration or the drain flow rate may increase as the temperature of the hot water tank is lower, the temperature of the hot water in the hot water tank is lower, or the temperature of the hot water detected by the second temperature sensor 120 is lower. The drain duration or drain flow rate may be increased or decreased in stepwise manner.

As described above, when the drain operation is completed, the hot water discharge valve 217 is opened for hot water dispensing (S106). (S106)

Then, the hot water dispensing is performed through the water discharge nozzle (S107).

Then, after a set amount of hot water is discharged, the hot water dispensing is completed.

Figure 6:
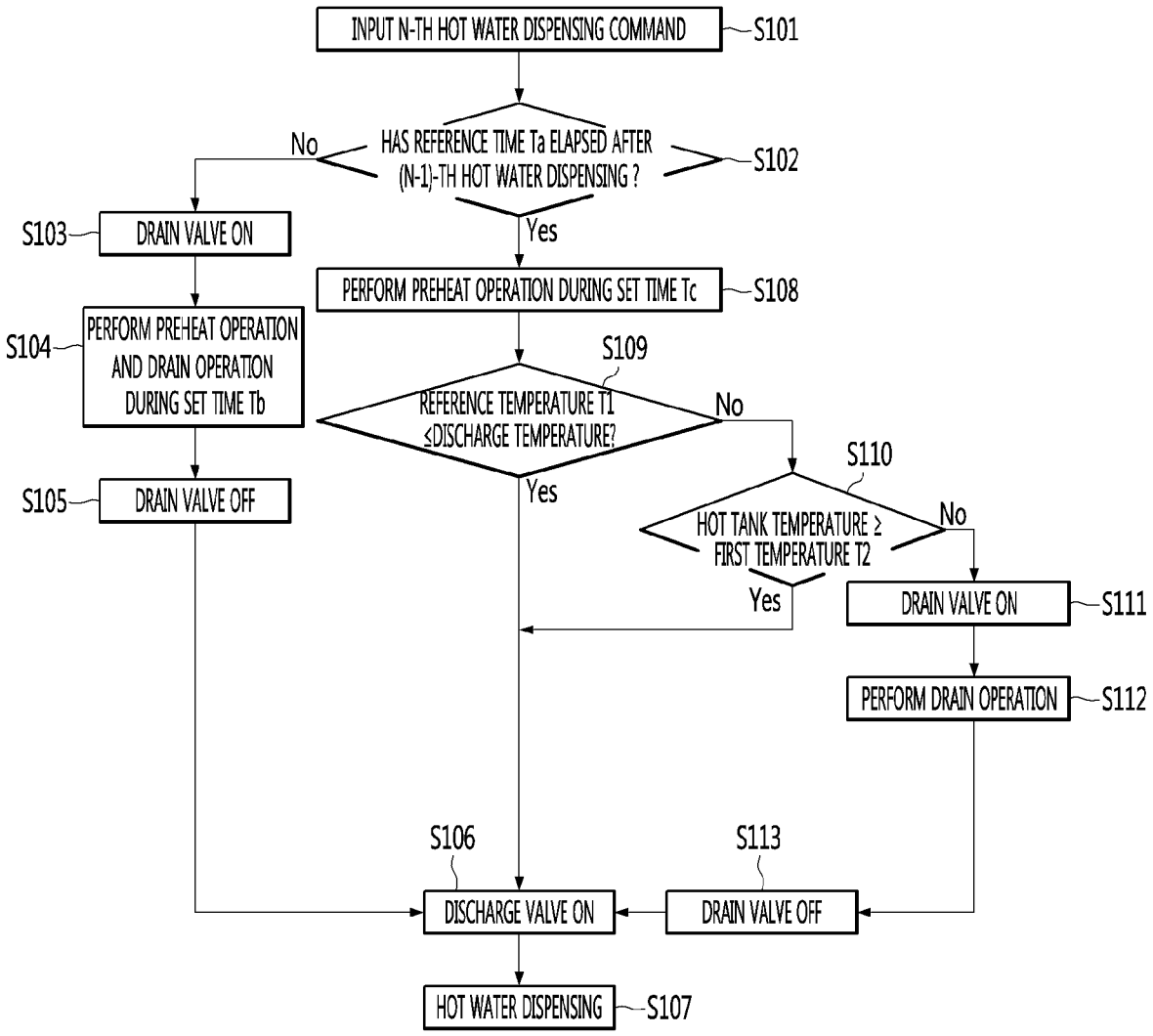
FIG. 6 is a flowchart showing an example of a control method for a water dispensing apparatus.

FIG. 6 is a flowchart showing an example control method for a water dispensing apparatus.

Referring to FIG. 6, first, an N-th hot water discharge command is input from a user (S101).

For example, the N-th hot water dispensing command may be input by an operation in which the user presses a hot water button and a water dispensing button of the input device 140 in order.

In some implementations, the controller 150 may determine whether the N-th hot water dispensing is the 'first cup' event or the 'repetitive cup' event (S102).

The criteria for the first cup and the repetitive cup may be set in various manners.

For example, when the N-th hot water dispensing command is input, the first cup event or the repetitive cup event may be determined depending on whether an elapsed time (hereinafter, standby time) detected by the timer 130 after the (N−1)-th hot water discharging is performed exceeds the reference time Ta.

In some examples, when the waiting time has exceeded the reference time Ta, the 'first cup' event may be determined.

When the waiting time is less than or equal to the reference time Ta, a 'repetitive cup' event may be determined.

For example, the reference time Ta may be set to 3 minutes.

In some examples, in step S102, when an N-th hot water dispensing corresponds to the repetitive cup event, preheat operation may be performed with drain operation.

As described above, when the N-th hot water dispensing is the 'repetitive cup' event, the temperature of the hot water tank 41 is maintained at a high temperature due to the influence of the (N−1)-th hot water dispensing. In this state, when only preheat operation is performed without drain operation, the temperature of the hot water tank 41 becomes too high, and a boiling phenomenon occurs in the hot water tank 41. Therefore, when the N-th hot water dispensing is the 'repetitive cup', drain operation is performed with preheat operation.

To this end, first, the drain valve 218 is opened (S103).

In this case, the hot water discharge valve 217 maintains a closed state.

Then, preheat operation and drain operation are performed during a set time Tb (S104).

When the set time Tb has elapsed, the drain valve 218 is closed (S105).

Then, the preheat operation and the raining are completed.

In step S104, the controller 150 may maintain the output of the working coil 42 for heating the hot water tank 41 substantially constant.

As another example, in step S104, the controller 150 may adjust the output of the working coil 42 for heating the hot water tank 41 in real time.

In detail, the controller 150 may detect factors such as a temperature of the hot water tank 41 or a temperature of hot water heated in the hot water tank 41, a temperature of purified water introduced into the hot water tank 41, a flow rate or flow speed of purified water introduced into the hot water tank 41, or the like in real time and adjust the output of the working coil 42 for heating the hot water tank 41 according to each factor.

Thereafter, the hot water discharge valve 217 is opened for hot water dispensing (S106).

Then, the hot water dispensing is performed through the water discharge nozzle (S107).

Then, after a set amount of hot water is discharged, the hot water dispensing is completed.

In some examples, in step S102, when the N-th hot water dispensing is the 'first cup' event, the preheat operation may be performed for a set time Tc (S108).

In this case, the drain valve 218 and the hot water discharge valve 217 maintain a closed state.

In step S108, the controller 150 may maintain the output of the working coil 42 for heating the hot water tank 41 substantially constant.

As another example, in step S108, the controller 150 may adjust the output of the working coil 42 for heating the hot water tank 41 in real time.

In detail, the controller 150 may detect factors such as a temperature of the hot water tank 41 or a temperature of hot water heated in the hot water tank 41, a temperature of purified water introduced into the hot water tank 41, a flow rate or flow speed of purified water introduced into the hot water tank 41, or the like in real time and adjust the output of the working coil 42 for heating the hot water tank 41 according to each factor.

Then, after the set time Tc has elapsed, the preheat operation is completed.

Thereafter, the controller 150 may compare a temperature of the hot water detected by the second temperature sensor 120 with a reference temperature T1 (S109).

When the detected temperature of hot water is equal to or greater than the reference temperature T1 as a result of comparison in step S109, the hot water discharge valve 217 is opened for hot water dispensing (S106). (S106)

Then, the hot water dispensing is performed through the water discharge nozzle (S107).

Then, after a set amount of hot water is discharged, the hot water dispensing is completed.

For reference, while the preheat operation is performed in step S108, a part of the hot water heated in the hot water tank 41 is discharged from the hot water tank 41, and the discharged hot water flows through a hot water pipe connecting the hot water tank 41 and the hot water discharge valve 217. Then, a temperature of water in the hot water pipe connecting the hot water tank 41 and the hot water discharge valve 217 rises due to the influence of the discharged hot water.

In some examples, when the detected temperature of the hot water is less than the reference temperature T1 as a result of the comparison in step S109, the drain operation is selectively performed before the hot water dispensing through the water discharge nozzle.

The controller 150 may compare a temperature of the hot water tank 41 detected by the first temperature sensor 110 or a temperature of the hot water in the hot water tank 41 with a first preset temperature T2 to determine whether to perform drain operation (S110).

In the step S110, if the temperature of the hot water tank 41 or the temperature of the hot water in the hot water tank 41 is more than the first preset temperature (T2), for the hot water withdrawal, the hot water discharge valve 217 is opened (S106).

Then, the hot water dispensing is performed through the water discharge nozzle (S107).

Then, after a set amount of hot water is discharged, the hot water dispensing is completed.

In the step S110, when the temperature of the hot water tank 41 or the temperature of the hot water in the hot water tank 41 is less than the first preset temperature T2, the drain valve 218 is opened for drain operation before the hot water dispensing (S106).

Then, the drain operation of the residual water in the hot water pipe connecting the hot water tank 41 and the hot water discharge valve 217 is performed.

When the drain operation is performed during a target time or the target amount of flow is drained, the drain valve 218 is closed and the drain operation is completed (S113).

The drain duration or drain flow rate may be set differently according to the temperature of the hot water tank, the temperature of the hot water in the hot water tank, or the temperature of the hot water detected by the second temperature sensor 120.

For example, the drain duration or the drain flow rate may increase as the temperature of the hot water tank is lower, the temperature of the hot water in the hot water tank is lower, or the temperature of the hot water detected by the second temperature sensor 120 is lower.

As described above, when the drain operation is completed, the hot water discharge valve 217 is opened for hot water dispensing (S106). (S106)

Then, the hot water dispensing is performed through the water discharge nozzle (S107).

Then, after a set amount of hot water is discharged, the hot water dispensing is completed.

In the present disclosure as described above, the second temperature sensor 120 is mounted on the hot water discharge valve 217 disposed adjacent to the water discharge nozzle. Therefore, satisfaction for the temperature of the hot water discharged to the water discharge nozzle may be improved.

As in the present disclosure, when a temperature sensor is mounted on the hot water discharge valve 127, the temperature sensor detects a temperature of hot water, and when the detected temperature of the hot water is not satisfied, the hot water in the pipe is drained, not supplied to the discharge nozzle and only when the temperature of the hot water detected by the temperature sensor is satisfied, the hot water may be supplied to the discharge nozzle.

Figure 7:
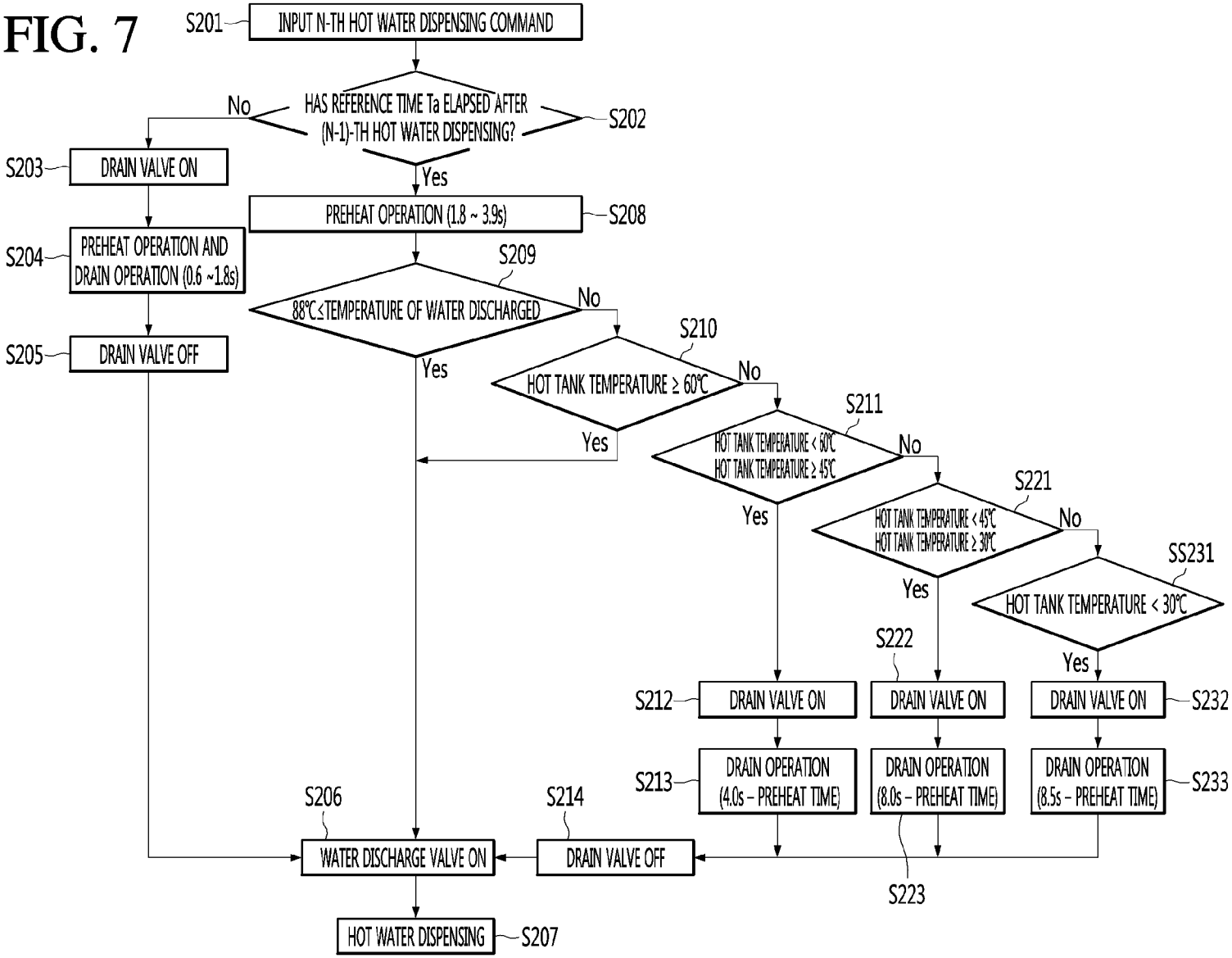
FIG. 7 is a flowchart showing an example of a control method for a water dispensing apparatus.

FIG. 7 is a flowchart showing an example control method for a water dispensing apparatus.

Referring to FIG. 7, first, an N-th hot water dispensing command is input from a user (S101).

For example, the N-th hot water dispensing command may be input by an operation in which the user presses a hot water button and a water dispensing button of the input device 140 in order.

In some implementations, the controller 150 may determine whether the N-th hot water dispensing is the 'first cup' event or the 'repetitive cup' event (S202).

The criteria for the first cup event and the repetitive cup event may be set in various manners.

For example, when the N-th hot water dispensing command is input, the first cup event and the repetitive cup event may be determined depending on whether an elapsed time (hereinafter, standby time) detected by the timer 130 after the (N−1)-th hot water discharging is performed exceeds three minutes.

In some examples, when the waiting time has exceeded three minutes, the 'first cup' event may be determined.

When the waiting time is less than or equal to three minutes, a 'repetitive cup' event may be determined.

In step S202, when an N-th hot water dispensing is determined to correspond to the "repetitive cup" event, a preheat operation may be performed with drain operation.

As described above, when the N-th hot water dispensing is the 'repetitive cup' event, the temperature of the hot water tank 41 is maintained at a high temperature due to the influence of the (N−1)-th hot water dispensing. In this state, when only preheat operation is performed without drain operation, the temperature of the hot water tank 41 becomes too high, and a boiling phenomenon occurs in the hot water tank 41. Therefore, when the N-th hot water dispensing is the 'repetitive cup' event, drain operation is performed with preheat operation.

To this end, first, the drain valve 218 is opened (S203).

In this case, the hot water discharge valve 217 maintains a closed state.

Then, preheat operation and drain operation are performed for a predetermined time of about 0.6 seconds to 1.8 seconds (S204).

Then, when the predetermined time of about 0.6 seconds to 1.8 seconds has elapsed, the drain valve 218 is closed (S205).

Then, the preheat operation and the raining are completed.

For reference, the preheat and drain duration may be set depending on a temperature of the purified water introduced to the hot water tank 41, a waiting time, a temperature of the hot water tank 41, a temperature of water in the hot water tank 41, or the like.

In some implementations, in step S204, the controller 150 may maintain the output of the working coil 42 for heating the hot water tank 41 substantially constant.

In step S204, the controller 150 may adjust the output of the working coil 42 for heating the hot water tank 41 in real time.

In detail, the controller 150 may detect factors such as a temperature of the hot water tank 41 or a temperature of hot water heated in the hot water tank 41, a temperature of purified water introduced into the hot water tank 41, a flow rate or flow speed of purified water introduced into the hot water tank 41, or the like in real time and adjust the output of the working coil 42 for heating the hot water tank 41 according to each factor.

Thereafter, the hot water discharge valve 217 is opened for hot water dispensing (S206).

Then, the hot water dispensing is performed through the water discharge nozzle (S207).

Then, after a set amount of hot water is discharged, the hot water dispensing is completed.

In step S202, when the N-th hot water dispensing is the 'first cup' event, preheat operation is performed for a time of 1.8 seconds to 3.9 seconds (S208).

In this case, the drain valve 218 and the hot water discharge valve 217 maintain a closed state.

For reference, the preheat time may be set depending on a temperature of the purified water introduced to the hot water tank 41, a waiting time, a temperature of the hot water tank 41, a temperature of water in the hot water tank 41, or the like.

For reference, when the preheat time is 3 minutes or more, the preheat time may be calculated by Equation 1 below.

In some implementations, when the preheat time is 3 minutes or more, the drain duration may be controlled differently for sections according to the temperature of the hot water tank (IH Tank, CLAD).

In some implementations, when the temperature of the hot water tank (IH Tank, CLAD) is above a certain temperature, the hot water may be discharged without separate drain operation to prevent water bounce completely. The water in a flow path is drained to satisfy the hot water dispensing temperature by differently setting a training time for each temperature section of the hot water tank (IH Tank, CLAD).

Preheat time=(IH Tank Max reference temperature−IH Tank temperature)*(39−8)/(IH Tank Max reference temperature−IH Tank Min reference temperature)+8 [Equation 1]

In some implementations, in step S208, the controller 150 may maintain the output of the working coil 42 for heating the hot water tank 41 substantially constant.

In step S208, the controller 150 may adjust the output of the working coil 42 for heating the hot water tank 41 in real time.

In detail, the controller 150 may detect factors such as a temperature of the hot water tank 41 or a temperature of hot water heated in the hot water tank 41, a temperature of purified water introduced into the hot water tank 41, a flow rate or flow speed of purified water introduced into the hot water tank 41, or the like in real time and adjust the output of the working coil 42 for heating the hot water tank 41 according to each factor.

Then, after a predetermined time of 1.8 seconds to 3.9 seconds has elapsed, preheat operation is completed.

Thereafter, the controller 150 may compare a temperature of the hot water detected by the second temperature sensor 120 with a reference temperature T1 (S209).

In detail, the controller 150 may compare a temperature of the hot water detected by the second temperature sensor 120 with 88° C. (S109).

When the detected temperature of hot water is equal to or greater than 88° C. as a result of comparison in step S209, the hot water discharge valve 217 is opened for hot water dispensing (S206).

Then, the hot water dispensing is performed through the water discharge nozzle (S207).

Then, after a set amount of hot water is discharged, the hot water dispensing is completed.

For reference, while the preheat operation is performed in step S208, a part of the hot water heated in the hot water tank 41 is discharged from the hot water tank 41, and the discharged hot water flows through a hot water pipe connecting the hot water tank 41 and the hot water discharge valve 217. Then, a temperature of water in the hot water pipe connecting the hot water tank 41 and the hot water discharge valve 217 rises due to the influence of the discharged hot water.

In some examples, when the detected temperature of the hot water is less than 88° C. as a result of the comparison in step S209, the drain operation is selectively performed before the hot water dispensing through the water discharge nozzle.

The controller 150 may compare a temperature of the hot water tank 41 detected by the first temperature sensor 110 with a first preset temperature T2 to determine whether to perform drain operation (S210).

In detail, the controller 150 may compare the temperature of the hot water tank 41 detected by the first temperature sensor 110 with 60° C.

In step S210, when the temperature of the hot water tank 41 is 60° C. or more, the hot water discharge valve 217 is opened for the hot water dispensing (S206).

Then, the hot water dispensing is performed through the water discharge nozzle (S207).

Then, after a set amount of hot water is discharged, the hot water dispensing is completed.

In some examples, in step S210, when the temperature of the hot water tank 41 is less than 60° C., the drain valve 218 is opened for drain operation before hot water dispensing (S212, s222, and S232).

Then, the drain operation of the residual water in the hot water pipe connecting the hot water tank 41 and the hot water discharge valve 217 is performed (S212, S222, and S232).

At this time, the drain duration is set differently according to the temperature of the hot water tank (41).

In detail, as the temperature of the hot water tank 41 is lower, the drain duration may be increased.

In some implementations, the drain duration may be increased or decreased in stepwise manner. For instance, the temperature of the hot water tank 41 may be compared to one or more preset temperatures.

In some examples, in step S210, if the temperature of the hot water tank 41 is less than the predetermined temperature 60° C., the controller 150 determines whether the temperature of the hot water tank 41 falls within the range of less than 60° C. and not less than 45° C. (S211).

If the temperature of the hot water tank 41 falls within the range of less than 60° C. and not less than 45° C., the drain valve 218 is opened for drain operation (S212).

Then, the drain operation of the residual water in the hot water pipe connecting the hot water tank 41 and the hot water discharge valve 217 is performed (S212, S222, and S232).

In this case, the drain duration may be determined by subtracting the preheat time (1.8 to 3.9 seconds) for which preheat operation is performed in step S208, from 4.0 seconds (S213).

As an example, in step S208, when the preheat operation is performed for 2.0 seconds, the drain operation may be performed for 2.0 seconds which is obtained by subtracting 2.0 seconds from 4.0 seconds.

As described above, after the drain operation is performed for the calculated time (2.0 seconds), the drain valve 218 is closed and the drain operation is completed (S214).

In some examples, in step S211, when the temperature of the hot water tank 41 does not fall within a range of less than 60° C. and not less than 45° C., the controller 150 determines whether a temperature of the hot water tank 41 falls within a range of less than 45° C. and not less than 30° C. (S221).

When the temperature of the hot water tank 41 falls within the range of less than 45° C. and not less than 30° C., the drain valve 218 is opened for drain operation (S222).

Then, the drain operation for the residual water in the hot water pipe connecting the hot water tank 41 and the hot water discharge valve 217 is performed (S223).

In this case, the drain duration may be determined by subtracting the preheat time (1.8 to 3.9 seconds) which is performed in step S208, from 8.0 seconds.

As an example, in step S208, when the preheat operation is performed for 3.0 seconds, the drain operation may be performed for 5.0 seconds which is obtained by subtracting 3.0 seconds from 8.0 seconds.

As described above, after the drain operation is performed for the calculated time (5.0 seconds), the drain valve 218 is closed and the drain operation is completed (S214).

In some examples, in step S221, if the temperature of the hot water tank 41 does not fall within the range of less than 45° C. and not less than 30° C., the controller 150 determines that the temperature of the hot water tank 41 falls within a range of less than 30° C. (S231).

To this end, the drain valve 218 is opened for drain operation (S232).

Then, the drain operation of the residual water in the hot water pipe connecting the hot water tank 41 and the hot water discharge valve 217 is performed (S233).

In some cases, the drain duration may be determined by subtracting the preheat time (1.8 to 3.9 seconds) for which preheat operation is performed in step S208, from 8.5 seconds.

As an example, in step S208, when the preheat operation is performed for 3.0 seconds, the drain operation may be performed for 5.5 seconds which is obtained by subtracting 3.0 seconds from 8.5 seconds.

As described above, after the drain operation is performed for the calculated time (5.5 seconds), the drain valve 218 is closed and the drain operation is completed (S234).

As described above, when the drain operation is completed, the hot water discharge valve 217 is opened for hot water dispensing (S206).

Then, the hot water dispensing is performed through the water discharge nozzle (S207).

Then, after a set amount of hot water is discharged, the hot water dispensing is completed.

Figure 8:
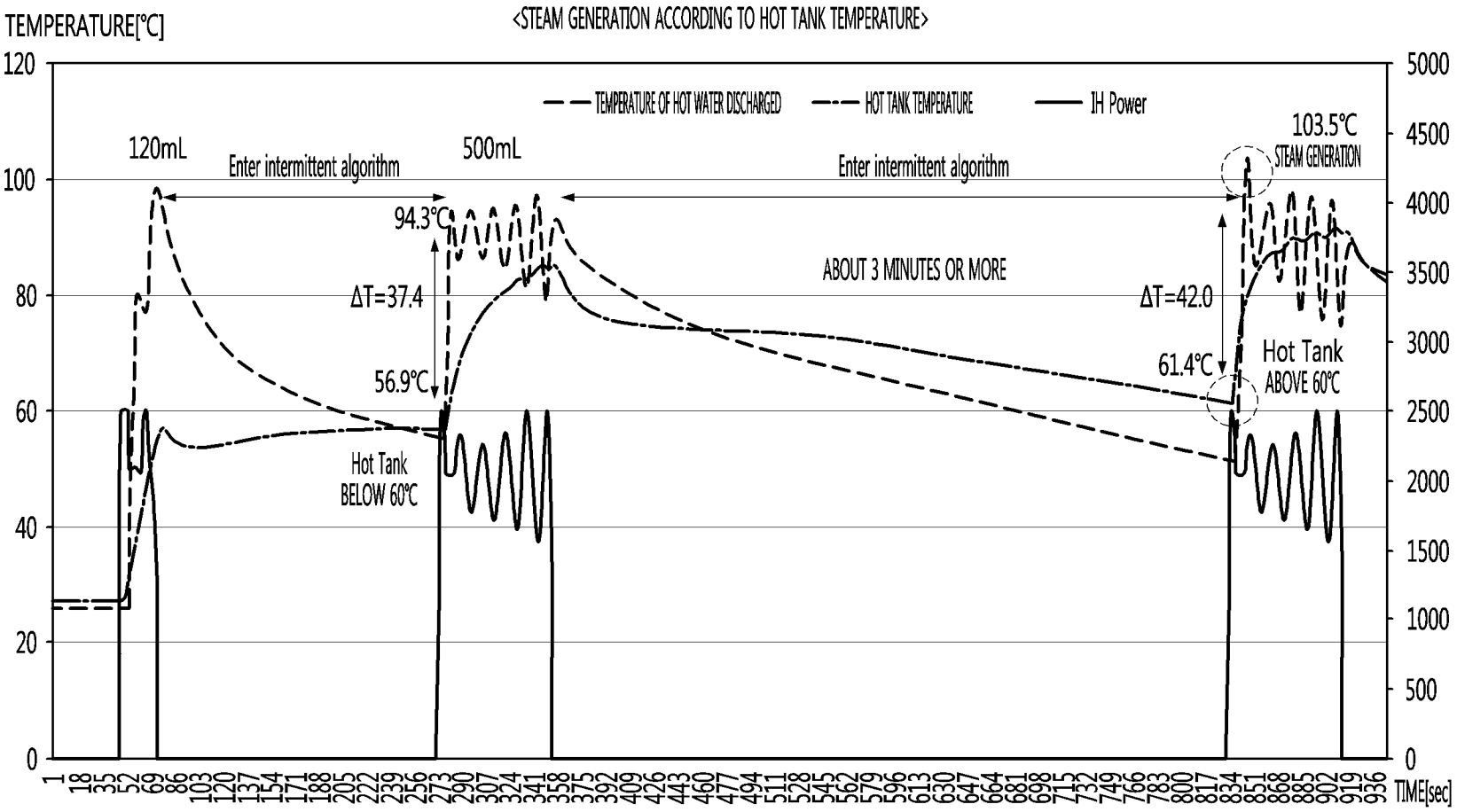
FIG. 8 is a graph showing examples of a change over time in power supplied to a hot water module and temperature changes of a hot water tank and a temperature of a hot water.

FIG. 8 is a graph comparing examples of a change over time in power supplied to the hot water module, a change over time in a temperature of the hot water tank, and a change over time in a temperature of hot water in a pipe detected by the second temperature sensor.

Experimental conditions are that the change with time in the power supplied to the hot water module, the change with time in the temperature of the hot water tank, and the change with time in the temperature of the hot water in the pipe detected by the second temperature sensor were measured in a case where hot water of 120 ml is first discharged, after a waiting time of 3 minutes or more has elapsed, hot water of 500 ml is discharged secondly, after the waiting time of 3 minutes or more has elapsed again, while hot water of 500 ml is discharged thirdly.

Since the waiting time between the first hot water discharge and the second hot water discharge is more than three minutes, a 'first cup' event logic was applied when the second hot water discharge is performed. In some implementations, since the waiting time between the second hot water discharge and the third hot water discharge is also 3 minutes or more, the 'first cup' event logic was applied when the third hot water discharge is performed as well.

Therefore, during the second hot water discharge and the third hot water discharge, only preheat operation is performed without drain.

First, just before the second hot water dispensing, the temperature of the hot water tank was measured at 56.9° C. In this state, even when preheat operation in performed, the temperature of the hot water is heated to 94.3° C. and does not exceed 100° C., so that it can be seen that no boiling phenomenon occurs.

In some examples, just before the third hot water dispensing, the temperature of the hot water tank was measured at 61.4° C. In this state, when preheat operation proceeded, the temperature of the hot water has reached to 103.5° C. and has exceeded 100° C., so that it can be seen that boiling has occurred.

Therefore, in a state where the temperature of the hot water tank is greater than or equal to 60° C., when the 'first cup' event logic is applied, steam due to the boiling phenomenon is generated, so that it is necessary to perform the drain operation or adjust the preheat time.

In the present disclosure as described above, the second temperature sensor 120 is mounted on the hot water discharge valve 217 disposed adjacent to the water discharge nozzle. Therefore, satisfaction for the temperature of the hot water discharged to the water discharge nozzle may be improved.

As in the present disclosure, when a temperature sensor is mounted on the hot water discharge valve 127, the temperature sensor detects a temperature of hot water, and when the detected temperature of the hot water is not satisfied, the hot water in the pipe is drained, not supplied to the discharge nozzle and only when the temperature of the hot water detected by the temperature sensor is satisfied, the hot water may be supplied to the discharge nozzle.

In some implementations, when the temperature of the residual water in the pipe detected by the temperature sensor of the hot water discharge valve 127 is in an unsatisfied state, the drain operation is not performed immediately, and the temperature of the hot water tank is checked to determine whether to perform drain. Therefore, unnecessary drain operation is prevented, and the user can be provided with hot water quickly.

In some implementations, by increasing the drain duration in stepwise manner according to the temperature of the hot water tank, it is possible to maintain the time required for the drain operation to the shortest time. Therefore, undesirably long drain operation can be prevented, and the user can be provided with hot water quickly.

What is claimed is:

1. A water dispensing apparatus comprising:

a filter configured to purify incoming water;

a hot water tank configured to receive and heat water having passed through the filter;

a water discharge nozzle configured to supply hot water generated in the hot water tank to a user;

a hot water pipe connecting the hot water tank to the water discharge nozzle;

a hot water discharge valve disposed at the hot water pipe and configured to control water flow through the hot water pipe;

a drain pipe branched from the hot water pipe;

a drain valve disposed at the drain pipe and configured to control flow of water introduced from the hot water pipe into the drain pipe;

a first temperature sensor disposed in the hot water tank and configured to detect a first temperature of the hot water tank or water in the hot water tank;

a second temperature sensor disposed in the hot water discharge valve and configured to detect a second temperature of water that is in the hot water pipe or introduced into the hot water discharge valve; and a controller configured to control the hot water discharge valve and the drain valve based on temperature information comprising the first temperature and the second temperature.

2. The water dispensing apparatus of claim 1, wherein the controller comprises a timer configured to, based on receiving a hot water dispensing command from the user, determine an elapsed time from a previous hot water dispensing event to a time point corresponding to the hot water dispensing command.

3. The water dispensing apparatus of claim 2, wherein the controller is configured to:

based on the elapsed time being less than a reference time, determine that the hot water dispensing command corresponds to a repetitive dispensing event; and perform a preheat operation of the hot water tank corresponding to the repetitive dispensing event in a state in which the hot water discharge valve is closed and the drain valve is opened.

4. The water dispensing apparatus of claim 3, wherein the controller is configured to finish the preheat operation based on (i) an elapse of a predetermined preheat time from beginning of the preheat operation or (ii) the first temperature being equal to a predetermined target temperature.

5. The water dispensing apparatus of claim 4, wherein the controller is configured to, based on completion of the preheat operation, close the drain valve and open the hot water discharge valve to thereby dispense hot water through the water discharge nozzle.

6. The water dispensing apparatus of claim 2, wherein the controller is configured to:

based on the elapsed time being greater than or equal to a reference time, determine that the hot water dispensing command corresponds to an individual dispensing event; and perform a preheat operation of the hot water tank corresponding to the individual dispensing event in a state in which the hot water discharge valve is closed and the drain valve is opened.

7. The water dispensing apparatus of claim 6, wherein the controller is configured to finish the preheat operation based on an elapse of a predetermined preheat time from beginning of the preheat operation.

8. The water dispensing apparatus of claim 7, wherein the controller is configured to open the hot water discharge valve to thereby dispense hot water through the water discharge nozzle based on the second temperature becoming greater than a predetermined reference temperature after completion of the preheat operation.

9. The water dispensing apparatus of claim 7, wherein the controller is configured to:

compare the first temperature to one or more preset temperatures based on the second temperature being less than a predetermined reference temperature after completion of the preheat operation.

10. The water dispensing apparatus of claim 9, wherein the controller is configured to:

based on the first temperature being greater than or equal to a first preset temperature among the one or more preset temperatures, open the hot water discharge valve to thereby dispense hot water through the water discharge nozzle.

11. The water dispensing apparatus of claim 10, wherein the controller is configured to:

based on the first temperature being less than the first preset temperature, open the drain valve to thereby perform a drain operation for draining water through the drain pipe before dispensing hot water through the water discharge nozzle.

12. The water dispensing apparatus of claim 11, wherein the controller is configured to determine a drain duration of the draining operation by subtracting the predetermined preheat time from one or more predetermined drain durations.

13. The water dispensing apparatus of claim 12, wherein the controller is configured to increase the one or more predetermined drain durations in a stepwise manner based on a decrease of the first temperature.

14. The water dispensing apparatus of claim 11, wherein the controller is configured to, based on completion of the drain operation, close the drain valve and open the hot water discharge valve to thereby dispense hot water through the water discharge nozzle.

15. A control method for a water dispensing apparatus, the method comprising:

receiving a hot water dispensing command from a user;

based on receiving the hot water dispensing command, determining an elapsed time from a previous hot water dispensing event to a time point corresponding to the hot water dispensing command;

comparing the elapsed time to a predetermined reference time;

based on the elapsed time being less than the predetermined reference time, determining that the hot water dispensing command is a repetitive dispensing event, and performing both of (i) a preheat operation configured to heat water in a hot water tank of the water dispensing apparatus and (ii) a drain operation configured to drain water from the water dispensing apparatus; and dispensing hot water based on completion of both of the preheat operation and the drain operation.

16. A control method for a water dispensing apparatus, the method comprising:

receiving a hot water dispensing command from a user;

based on receiving the hot water dispensing command, determining an elapsed time from a previous hot water dispensing event to a time point corresponding to the hot water dispensing command;

comparing the elapsed time to a predetermined reference time;

based on the elapsed time being greater than or equal to the predetermined reference time, determining that the hot water dispensing command corresponds to an individual dispensing event, and performing a preheat operation configured to heat water in a hot water tank of the water dispensing apparatus;

detecting a temperature of hot water flowing into a discharge nozzle of the water dispensing apparatus;

comparing the temperature of hot water to a reference temperature; and dispensing hot water based on the temperature of hot water being greater than or equal to the reference temperature.

17. A control method for a water dispensing apparatus, the method comprising:

receiving a hot water dispensing command from a user;

based on receiving the hot water dispensing command, determining an elapsed time from a previous hot water dispensing event to a time point corresponding to the hot water dispensing command;

comparing the elapsed time to a predetermined reference time;

based on the elapsed time being greater than or equal to the predetermined reference time, determining that the hot water dispensing command corresponds to an individual dispensing event, and performing a preheat operation configured to heat water in a hot water tank of the water dispensing apparatus;

detecting a temperature of hot water flowing into a discharge nozzle of the water dispensing apparatus;

comparing the temperature of hot water to a reference temperature;

based on the temperature of hot water being less than the reference temperature, performing a drain operation configured to drain water from the water dispensing apparatus; and dispensing hot water based on completion of the drain operation.

18. The method of claim 17, further comprising:

comparing a temperature of the hot water tank to a first preset temperature based on the temperature of hot water being less than the reference temperature.

19. The method of claim 17, wherein performing the preheat operation comprises performing the preheat operation for a predetermined preheat time, and wherein the method further comprises:

determining a drain duration of the draining operation by subtracting the predetermined preheat time from one or more predetermined drain durations.

20. The method of claim 19, wherein determining the drain duration comprises increasing the one or more predetermined drain durations based on a decrease of the temperature of hot water.

* * * * *